US009950912B2

(12) United States Patent
Zhang et al.

(10) Patent No.: US 9,950,912 B2
(45) Date of Patent: Apr. 24, 2018

(54) COMBINED COUNTERWEIGHT HITCHING DEVICE AND METHOD THEREOF, AND COUNTERWEIGHT MOUNTING STRUCTURE

(71) Applicant: Xuzhou Heavy Machinery Co., Ltd., Xuzhou, Jiangsu (CN)

(72) Inventors: Zhengde Zhang, Xuzhou (CN); Haiyan Zhang, Xuzhou (CN); Rong Jin, Xuzhou (CN); Xiaodong Hu, Xuzhou (CN); Quansheng Huang, Xuzhou (CN)

(73) Assignee: XUZHOU HEAVY MACHINERY CO., LTD., Xuzhou (CN)

( * ) Notice: Subject to any disclaimer, the term of this patent is extended or adjusted under 35 U.S.C. 154(b) by 0 days.

(21) Appl. No.: 15/313,665

(22) PCT Filed: May 26, 2014

(86) PCT No.: PCT/CN2014/078378
§ 371 (c)(1),
(2) Date: Nov. 23, 2016

(87) PCT Pub. No.: WO2015/180007
PCT Pub. Date: Dec. 3, 2015

(65) Prior Publication Data
US 2017/0253467 A1 Sep. 7, 2017

(51) Int. Cl.
*B66C 23/76* (2006.01)
*B66C 23/74* (2006.01)

(52) U.S. Cl.
CPC ..... *B66C 23/76* (2013.01); *B66C 23/74* (2013.01)

(58) Field of Classification Search
CPC combination set(s) only.
See application file for complete search history.

(56) References Cited

U.S. PATENT DOCUMENTS 5,199,583 A * 4/1993 Weider ..... B66C 23/74 212/178
5,524,777 A * 6/1996 Weber ..... B66C 23/74 212/178

(Continued)

FOREIGN PATENT DOCUMENTS

CN 1569606 1/2005
CN 201214604 4/2009

(Continued)

OTHER PUBLICATIONS

Extending European Search Report for corresponding EP application No. 14893199.1 dated Dec. 21, 2017, 5 pages.

*Primary Examiner* — Nicole T Verley
(74) *Attorney, Agent, or Firm* — Myers Bigel, P.A.

(57) ABSTRACT

The present invention relates to a combined counterweight hitching device and method thereof, and a counterweight mounting structure. The combined counterweight hitching device is mounted on a turntable tail framework, wherein the combined counterweight hitching device includes a turntable tail framework bottom plate, a lifting oil cylinder, a lifting oil cylinder fixing seat and a hitching driving mechanism, the turntable tail framework bottom plate is fixed on the turntable tail framework, the lifting oil cylinder fixing seat is arranged on the upper surface of the turntable tail framework bottom plate and is hinged with the turntable tail framework bottom plate, the lifting oil cylinder is fixed at one end of the lifting oil cylinder fixing seat, the one end distal to a point on which the turntable tail framework bottom plate is hinged with the lifting oil cylinder fixing seat, a hitching platform is mounted at a piston rod end of the lifting oil cylinder, and the hitching driving mechanism is connected with the lifting oil cylinder fixing seat, and drives the lifting oil cylinder fixing seat to make the hitching platform enter a hitching platform groove on the counter- (Continued)

weight to complete a hitching operation. By adopting the combined counterweight hitching device and method, and the counterweight mounting structure provided by the present invention, the mounting and demounting of the combined counterweight are more convenient, and the mounting space is smaller.

12 Claims, 3 Drawing Sheets

(56) References Cited

U.S. PATENT DOCUMENTS

| | | | | |
|---|---|---|---|---|
| 7,611,021 | B2 * | 11/2009 | Willim | B66C 23/74 212/178 |
| 8,033,572 | B2 * | 10/2011 | Arzberger | B66C 23/74 280/755 |
| 8,739,989 | B2 * | 6/2014 | Liu | B66C 23/74 212/195 |
| 2008/0090074 | A1 | 4/2008 | Matsumura et al. | |
| 2016/0221804 | A1 * | 8/2016 | Torghele | B66C 23/76 |

FOREIGN PATENT DOCUMENTS

| | | | | | |
|---|---|---|---|---|---|
| CN | 102627230 | | | 8/2012 | |
| CN | 103569964 | | | 2/2014 | |
| CN | 203529808 | | | 4/2014 | |
| DE | 4405780 | A1 | * | 8/1995 | B66C 23/74 |
| DE | 29621600 | U1 | * | 2/1997 | B66C 23/74 |
| DE | 10019863 | A1 | * | 10/2001 | B66C 23/74 |
| DE | 10226318 | | | 1/2004 | |
| EP | 0582401 | | | 2/1994 | |
| EP | 0734994 | A1 | * | 10/1996 | B66C 23/74 |
| EP | 2543621 | | | 1/2013 | |
| JP | 2006001745 | A | * | 1/2006 | B66C 23/74 |
| JP | 2010195589 | A | * | 9/2010 | B66C 23/74 |
| WO | WO-2013056413 | A1 | * | 4/2013 | B66C 23/74 |

* cited by examiner

COMBINED COUNTERWEIGHT HITCHING DEVICE AND METHOD THEREOF, AND COUNTERWEIGHT MOUNTING STRUCTURE

RELATED APPLICATIONS

The present application is a 35 U.S.C. § 371 national phase application of PCT International Application No. PCT/CN2014/078378, filed May 26, 2014; the disclosure of which is hereby incorporated herein by reference in its entirety. PCT International Application No. PCT/CN2014/078378 is published in Chinese as PCT Publication No. WO 2015/180007.

FIELD OF THE INVENTION

The present invention relates to the field of engineering machinery, and particularly relates to a combined counterweight hitching device and method thereof, and a counterweight mounting structure.

BACKGROUND OF THE INVENTION

At present, medium and large tonnage wheeled cranes are applied more and more widely, and the lifting capability has been improved continuously, resulting in larger and larger self weights of the cranes, which are far more than the stringent requirements on the total weights and axle loads of the cranes. Therefore, in order to comply with this transportation requirement of the wheeled cranes, the most basic operating devices are only carried at a general running state, and other devices need to be demounted and transported separately. In order to ensure rapid transfer, quick and simple assembly and fast operation of the wheeled cranes, the mounting and demounting of the separate transported devices must be simple and convenient, and the purpose of rapid demounting and mounting is achieved while minimizing the time, manpower and material resources.

A combined counterweight is a device, which is widely used in the medium and large tonnage wheeled cranes, needs to be transported separately and aims at improving the lifting performance of the cranes on medium and long arms and on large amplitudes and giving full play to the performance of lifting arms and other main structural members. When the cranes are on the road, the combined counterweight needs to be demounted to meet relevant requirements and needs to be demounted and mounted once each time when the cranes are transferred for a long distance, therefore a method must be found for frequently mounting and demounting the combined counterweight with fast and convenient operation and without relying on auxiliary equipment.

Currently, the counterweight of the wheeled crane is mainly hitched in such a manner that after a piston rod of a lifting oil cylinder stretches into a hitching hole, the lifting oil cylinder is driven by a turntable to rotate to enable a hitching platform at the lower end of the piston rod to enter a hitching platform groove, and the oil cylinder retracts to mount the combined counterweight. After the piston rod enters the hitching hole, the hitching platform at the lower end of the piston rod needs to enter the hitching platform groove, which requires the whole upperstructure of the wheeled crane to rotate, so that the mounting space is large and the working efficiency is low. Meanwhile, to accurately locate the lifting oil cylinder and the mounting hole, a plurality of position detecting devices need to be provided, otherwise at least two operators need to cooperate to mount and demount the counterweight. In addition, in the existing technical solutions, the hitching platform at the lower end of the piston rod is in rigid connection with the piston rod, and the counterweight is located by the oil cylinder, when the counterweight swings slightly, the piston rod bears an offset load force and is subjected to an oil leakage phenomenon or even subjected to failure and breakage if working for a long time.

SUMMARY OF THE INVENTION

In view of this, the technical problem to be solved in the present invention is to provide a combined counterweight hitching device and method thereof, and a counterweight mounting structure, for ensuring more convenient mounting and demounting and a smaller mounting space for a combined counterweight.

the present invention provides the following technical solutions:

the embodiments of the present invention provide a combined counterweight hitching device mounted on a turntable tail framework, wherein the combined counterweight hitching device includes a turntable tail framework bottom plate, a lifting oil cylinder, a lifting oil cylinder fixing seat and a hitching driving mechanism, the turntable tail framework bottom plate is fixed on the affiliated turntable tail framework, the lifting oil cylinder fixing seat is arranged on the upper surface of the turntable tail framework bottom plate and is hinged with the turntable tail framework bottom plate, the lifting oil cylinder is fixed at one end of the lifting oil cylinder fixing seat, the one end distal to a point on which the turntable tail framework bottom plate is hinged with the lifting oil cylinder fixing seat, a hitching platform is mounted at a piston rod end of the lifting oil cylinder, and the hitching driving mechanism is connected with the lifting oil cylinder fixing seat, and drives the lifting oil cylinder fixing seat to make the hitching platform enter a hitching platform groove on the counterweight to complete a hitching operation.

Further, the hitching driving mechanism is a horizontal oil cylinder, one end of the horizontal oil cylinder is hinged on the turntable tail framework or the turntable tail framework bottom plate, and the other end of the horizontal oil cylinder is hinged on one end corresponding to the lifting oil cylinder on the lifting oil cylinder fixing seat.

Further, an annular structure used for fixing the cylinder barrel of the lifting oil cylinder is arranged on the end corresponding to the lifting oil cylinder on the lifting oil cylinder fixing seat, and the piston rod of the lifting oil cylinder extends through the center of the annular structure and extends below the turntable tail framework bottom plate.

Further, an arc-shaped hole matched with the horizontal movement track of the piston rod of the lifting oil cylinder is formed in the turntable tail framework bottom plate.

Further, the hitching platform is hinged with the piston rod end of the lifting oil cylinder through a spherical hinge.

Further, at least one locating groove is further formed in the turntable bottom framework bottom plate and is matched with a locating block on a counterweight to be hitched.

The embodiments of the present invention further provide a counterweight mounting structure, including a combined counterweight, wherein the counterweight mounting structure further includes the foregoing combined counterweight hitching device.

Further, the combined counterweight includes a basic counterweight and a movable counterweight, the basic counterweight includes an upper counterweight and a lower counterweight, the lower counterweight is provided with an upright post used for fixing the movable counterweight, the movable counterweight is arranged between the upper counterweight and the lower counterweight, a mounting hole matched with the piston rod end of the lifting oil cylinder in the combined counterweight hitching device is formed in the upper counterweight, a hitching platform groove is formed in the upper end of the upright post of the lower counterweight, and the hitching platform mounted at the piston rod end can be driven by the hitching driving mechanism in the combined counterweight hitching device to move in the mounting hole to the hitching platform groove to complete a hitching operation.

Further, at least one locating groove is further formed in the turntable bottom framework bottom plate in the combined counterweight hitching device, and at least one locating block matched with the at least one locating groove is arranged on the upper counterweight.

The embodiments of the present invention further provide a combined counterweight hitching method, including the following steps:

placing a combined counterweight on a vehicle frame, turning a turntable right astern and locking the turntable to locate the combined counterweight below a turntable tail framework;

driving a horizontal oil cylinder to extend and retract to drive a lifting oil cylinder fixing seat to move, so as to align the lifting oil cylinder with a mounting hole in the combined counterweight;

driving the lifting oil cylinder to extend out a piston rod to enable a hitching platform mounted at the piston rod end to enter the mounting hole in the combined counterweight;

driving the horizontal oil cylinder to extend and retract to drive the lifting oil cylinder fixing seat to move, so as to enable the hitching platform to enter a hitching platform groove on the combined counterweight; and driving the lifting oil cylinder to retract the piston rod to drive the combined counterweight to rise until the combined counterweight contacts a turntable tail framework bottom plate.

Further, when placing the combined counterweight, the combined counterweight is placed and located under the assistance of a locating device arranged on the vehicle frame.

Further, when driving the lifting oil cylinder to retract the piston rod to drive the combined counterweight to rise, a locating block on the combined counterweight cooperates with a locating groove on the turntable tail framework bottom plate for guiding.

The technical effects of the aforementioned technical solutions are analyzed as follows:

by means of the cooperation movement of the lifting oil cylinder arranged on the turntable tail framework bottom plate and the hitching driving mechanism connected with the fixed lifting oil cylinder in the present invention, the hitching platform mounted at the piston rod end of the lifting oil cylinder can enter the hitching platform groove on the counterweight through the hitching driving mechanism to complete the hitching operation of the combined counterweight. In this process, the turntable does not need to move on the whole to drive the lifting oil cylinder to rotate, so the mounting space is smaller. On the operation, the process of the hitching platform entering the hitching platform groove only needs to be driven by the hitching driving mechanism, therefore the operation is more convenient, and a demounting process can also be achieved under the drive of the hitching driving mechanism, so that the operation is convenient.

DETAILED DESCRIPTION OF THE EMBODIMENTS

Technical solutions of the present invention will be further described below in detail in combination with accompanying drawings and embodiments.

Figure 1A:
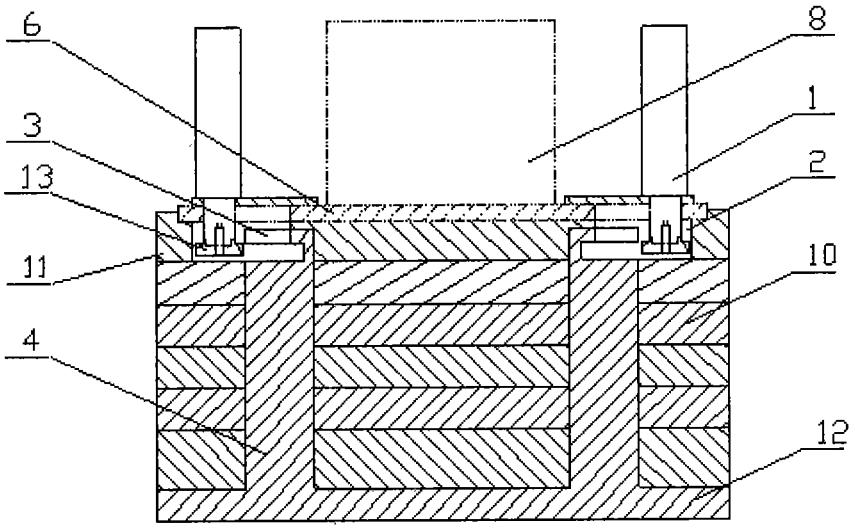
FIG. 1A and FIG. 1B are structural schematic diagrams of an embodiment of a combined counterweight hitching device of the present invention.
Figure 1B:
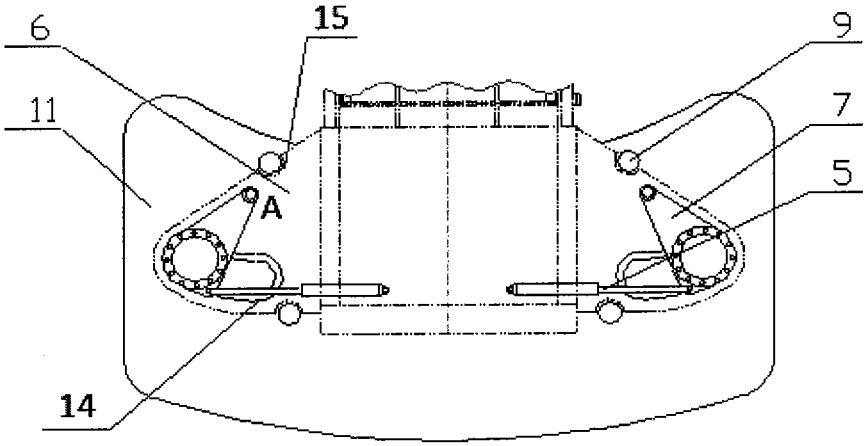

FIG. 1A and FIG. 1B show schematic diagrams of a structure of an embodiment of a combined counterweight hitching device of the present invention. In the embodiment, the combined counterweight hitching device is mounted on a turntable tail framework 8, the combined counterweight hitching device includes a turntable tail framework bottom plate 6, a lifting oil cylinder 1, a lifting oil cylinder fixing seat 7 and a hitching driving mechanism, and the turntable tail framework bottom plate 6 is fixed on the turntable tail framework 8. The lifting oil cylinder fixing seat 7 is arranged on the upper surface of the turntable tail framework bottom plate 6 and is hinged with the turntable tail framework bottom plate 6, the lifting oil cylinder 1 is fixed at one end of the lifting oil cylinder fixing seat 7, and the one end being distal to a point A on which the turntable tail framework bottom plate 6 is hinged with the lifting oil cylinder fixing seat 7. A hitching platform 13 is mounted at a piston rod end of the lifting oil cylinder 1. The hitching driving mechanism is connected with the lifting oil cylinder fixing seat 6, and can drive the lifting oil cylinder fixing seat 6 to make the hitching platform 13 (see FIG. 2) enter a hitching platform groove 3 on the counterweight 4 to complete a hitching operation.

It can be seen from FIG. 1B that, the hitching driving mechanism can adopt a simple form of a horizontal oil cylinder 5, one end of the horizontal oil cylinder 5 is able to be hinged on the turntable tail framework 8 or the turntable tail framework bottom plate 6, and the other end of the horizontal oil cylinder is hinged on one end corresponding to the lifting oil cylinder 1 on the lifting oil cylinder fixing seat 7. The lifting oil cylinder fixing seat 7 can be driven by the extension and retraction of the horizontal oil cylinder 5 to move along an arc-shaped track with the hinge point A as a circle center, so as to drive the lifting oil cylinder 1 to change the position relative to the turntable bottom framework bottom plate 8. A hitching position of the lifting oil cylinder 1 can be determined by a limiting position of the horizontal oil cylinder 5, when completely retracting, the horizontal oil cylinder 5 drives the lifting oil cylinder 1 to arrive at a hitching position adjacent to the turntable bottom framework 6, and when completely extending out, the horizontal oil cylinder 5 drives the lifting oil cylinder to arrive at a mounting position distal to the turntable bottom framework 6. The hinge point of the horizontal oil cylinder 5 with the turntable tail framework 8 or the turntable tail framework bottom plate 6 can also be arranged at a position distal to the turntable tail framework 8 on the turntable tail framework bottom plate 6, besides being arranged at a position adjacent to the turntable tail framework 8. In this way, the horizontal oil cylinder 5 can completely retract to correspond to the mounting position of the lifting oil cylinder 1 and completely extend out to correspond to the hitching position of the lifting oil cylinder 1.

Besides adopting the horizontal oil cylinder to serve as the hitching driving mechanism, other mechanisms can also be adopted, such as a link mechanism and the like, the link mechanism can achieve a reciprocating motion of hitching and disengaging between the lifting oil cylinder and the counterweight 4, the synchronism is better, but the link mechanism is more complex than the form of the horizontal oil cylinder.

To save space, an annular structure used for fixing the cylinder barrel of the lifting oil cylinder 1 can be arranged on the end corresponding to the lifting oil cylinder 1 on the lifting oil cylinder fixing seat 7, and the piston rod of the lifting oil cylinder 1 can extend through the center of the annular structure and extend below the turntable tail framework bottom plate 6. Correspondingly, an arc-shaped hole 14 matched with the horizontal movement track of the piston rod of the lifting oil cylinder 1 can be formed in the turntable tail framework bottom plate 6, and the arc-shaped hole 14 can guide the horizontal movement of the lifting oil cylinder 1.

Figure 2:
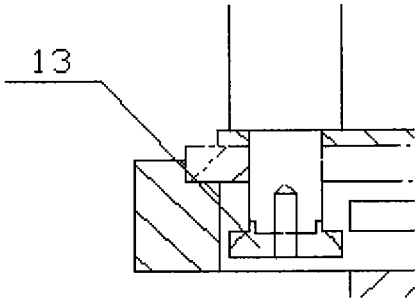
FIG. 2 is a schematic diagram of a connecting structure between a piston rod end of a lifting oil cylinder and a hitching platform in the embodiment of the combined counterweight hitching device of the present invention.

FIG. 2 shows a schematic diagram of a connecting structure between the piston rod end of the lifting oil cylinder and the hitching platform in the embodiment of the combined counterweight hitching device in the present invention. In the connecting structure of the hitching platform 13 and the piston rod end of the lifting oil cylinder 1, a spherical hinge connecting form is preferably adopted. Therefore, in the case of slight inclination of the counterweight caused by asynchronous hitching, the hitching platform in the spherical hinge form can effectively prevent the piston rod of the lifting oil cylinder 1 from bearing side load, so as to avoid an oil leakage phenomenon or even a failure and breakage problem of the piston rod when working for a long time under the side load.

Figure 3:
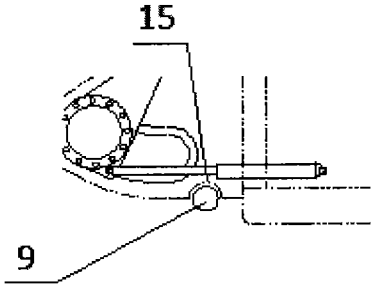
FIG. 3 is a schematic diagram of a guide structure of a combined counterweight and a turntable tail framework bottom plate in the embodiment of the combined counterweight hitching device of the present invention.

At least one locating groove 15 is formed in the turntable bottom framework bottom plate 6 and is matched with a locating block 9 on a counterweight to be hitched, as shown in FIG. 3. When the lifting oil cylinder 1 lifts the counterweight, the locating groove can be used for guiding the counterweight and keeping stable rise of the counterweight to avoid bending deformation of the lifting oil cylinder 1 resulting from rotary inertia of the upperstructure.

Figure 6:
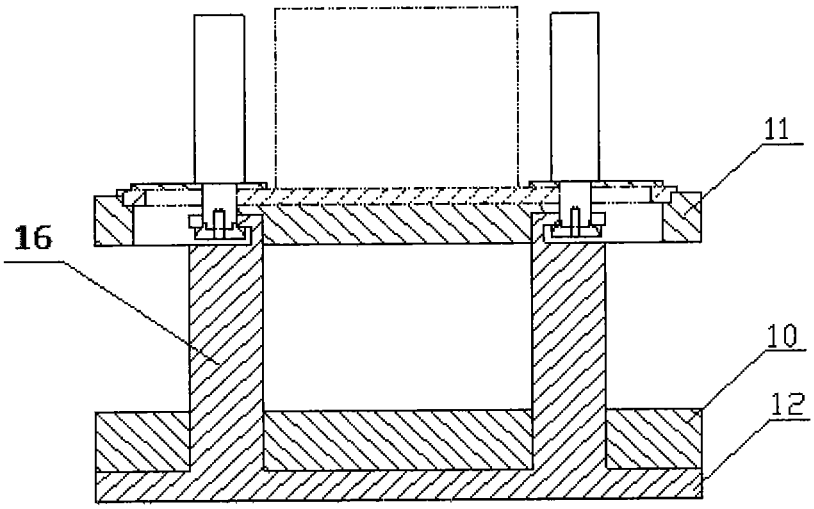
FIG. 6 is a schematic diagram of a structure of an embodiment of a counterweight mounting structure of the present invention.

An overall structure of a counterweight mounting structure in the present invention will be illustrated below in combination with FIG. 6. The counterweight mounting structure includes a combined counterweight (i.e., the counterweight 4 mentioned above) and the combined counterweight hitching device described above. The combined counterweight includes a basic counterweight and a movable counterweight 10, the basic counterweight forms a basic framework of the combined counterweight, the movable counterweight 10 can be increased and decreased according to demand, the basic counterweight includes an upper counterweight 11 and a lower counterweight 12, the lower counterweight 12 plays a role of loading and fixing the movable counterweight 10, the lower counterweight 12 is provided with an upright post 16 used for fixing the movable counterweight 10, the movable counterweight 10 is arranged between the upper counterweight 10 and the lower counterweight 12, the upper counterweight 10 mainly plays a role of cooperating with the lifting oil cylinder 1 and the turntable bottom framework bottom plate 6, a mounting hole 2 matched with the piston rod end of the lifting oil cylinder 1 is formed in the upper counterweight 10, a hitching platform groove 3 is formed in the upper end of the upright post 16 of the lower counterweight 12, and the hitching platform 13 mounted at the piston rod end of the lifting oil cylinder 1 can be driven by the hitching driving mechanism to move in the mounting hole 2 to the hitching platform groove 3 to complete a hitching operation.

It can be further seen from FIG. 1B that, at least one locating groove 15 is formed in the turntable bottom framework bottom plate 6, and at least one locating block 9 matched with the at least one locating groove 15 is correspondingly arranged on the upper counterweight 10.

A combined counterweight hitching method of the combined counterweight hitching device provided by the present invention will be illustrated below in combination with state diagrams as shown in FIGS. 4A, 4B, 5A and 5B.

Figure 4A:
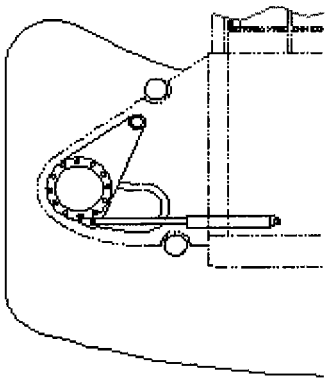
FIGS. 4A, 4B, 5A and 5B are respectively schematic diagrams of two states of using the embodiment of the combined counterweight hitching device of the present invention to hitch the combined counterweight.
Figure 4B:
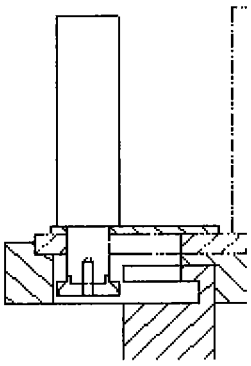

At first, the combined counterweight is placed on a vehicle frame, a turntable is turned right astern and is locked to locate the combined counterweight below the turntable tail framework, then the horizontal oil cylinder is driven to extend and retract to drive a lifting oil cylinder fixing seat to move, so as to align the lifting oil cylinder with the mounting hole in the combined counterweight, and then, the lifting oil cylinder is driven to extend out the piston rod to enable the hitching platform mounted at the piston rod end to enter the mounting hole in the combined counterweight, namely in the state as shown in FIGS. 4A and 4B.

Figure 5A:
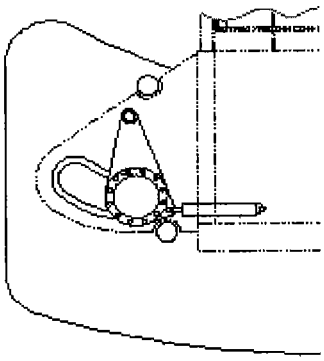
Figure 5B:
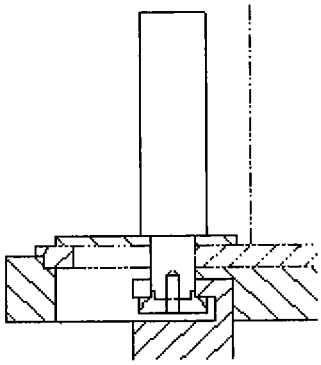

Then, the horizontal oil cylinder is driven to extend and retract to drive the lifting oil cylinder fixing seat to move. At this time, the piston rod of the lifting oil cylinder moves in the mounting hole along the arc-shaped hole in the turntable bottom framework bottom plate, and the hitching platform enters the hitching platform groove on the combined counterweight, namely in the state diagrams as shown in FIGS. 5A and 5B. The lifting oil cylinder is driven to retract the piston rod to drive the combined counterweight to rise until the combined counterweight contacts the turntable tail framework bottom plate.

In this process, when placing the combined counterweight, the combined counterweight can be placed and located under the assistance of a locating device arranged on the vehicle frame. When driving the lifting oil cylinder to retract the piston rod to drive the combined counterweight to rise, the locating block on the combined counterweight can cooperate with the locating groove on the turntable tail framework bottom plate for guiding. Meanwhile, the bending deformation of the lifting oil cylinder resulting from inertia in a rotation working process of the upperstructure after the counterweight is mounted can be avoided.

To demount the combined counterweight from the turntable tail framework, the lifting oil cylinder can be driven to extend and retract to lower the combined counterweight to a supportable position (for example, the ground or the vehicle frame), the hitching platform on the piston rod of the lifting oil cylinder is disengaged from the hitching platform groove and arrives an accessible position in the mounting hole through the hitching driving mechanism, and then the lifting oil cylinder is driven to extend and retract to enable the piston rod to take out the hitching platform from the mounting hole, so that the combined counterweight hitching device is completely separated from the combined counterweight. This demounting process is as simple and convenient as the hitching process.

The foregoing descriptions are merely preferred implementations of the present invention, it should be noted that, those of ordinary skill in the art can made a variety of improvements and modifications on the premise of not departing from the principle of the present invention, and these improvements and modifications should be encompassed in the protection scope of the present invention.

The invention claimed is:

1. A combined counterweight hitching device mounted on a turntable tail framework, wherein the combined counterweight hitching device comprises a turntable tail framework bottom plate, a lifting oil cylinder, a lifting oil cylinder fixing seat and a hitching driving mechanism, the turntable tail framework bottom plate is fixed on the turntable tail framework, the lifting oil cylinder fixing seat is arranged on an upper surface of the turntable tail framework bottom plate and is hinged with the turntable tail framework bottom plate, the lifting oil cylinder is fixed at one end of the lifting oil cylinder fixing seat, the one end being distal to a point on which the lifting oil cylinder fixing seat is hinged with the turntable tail framework bottom plate, a hitching platform is mounted at a piston rod end of the lifting oil cylinder, and the hitching driving mechanism is connected with the lifting oil cylinder fixing seat, and drives the lifting oil cylinder fixing seat to make the hitching platform enter a hitching platform groove on the counterweight to complete a hitching operation.

2. The combined counterweight hitching device of claim 1, wherein the hitching driving mechanism is a horizontal oil cylinder, one end of the horizontal oil cylinder is hinged on the turntable tail framework or the turntable tail framework bottom plate, and the other end of the horizontal oil cylinder is hinged on an end corresponding to the lifting oil cylinder on the lifting oil cylinder fixing seat.

3. The combined counterweight hitching device of claim 2, wherein an annular structure used for fixing the cylinder barrel of the lifting oil cylinder is arranged on the end corresponding to the lifting oil cylinder on the lifting oil cylinder fixing seat, and the piston rod of the lifting oil cylinder extends through the center of the annular structure and extends below the turntable tail framework bottom plate.

4. The combined counterweight hitching device of claim 3, wherein an arc-shaped hole matched with the horizontal movement track of the piston rod of the lifting oil cylinder is provided on the turntable tail framework bottom plate.

5. The combined counterweight hitching device of claim 1, wherein the hitching platform is hinged with the piston rod end of the lifting oil cylinder through a spherical hinge.

6. The combined counterweight hitching device of claim 1, wherein at least one locating groove is further provided on the turntable bottom framework bottom plate and is matched with a locating block on a counterweight to be hitched.

7. A counterweight mounting structure, comprising a combined counterweight, wherein the counterweight mounting structure further comprises the combined counterweight hitching device according to claim 1.

8. The counterweight mounting structure of claim 7, wherein the combined counterweight comprises a basic counterweight and a movable counterweight, the basic counterweight comprises an upper counterweight and a lower counterweight, the lower counterweight is provided with an upright post used for fixing the movable counterweight, the movable counterweight is arranged between the upper counterweight and the lower counterweight, a mounting hole matched with the piston rod end of the lifting oil cylinder in the combined counterweight hitching device is provided on the upper counterweight, a hitching platform groove is provided on the upper end of the upright post of the lower counterweight, and the hitching platform mounted at the piston rod end is able to be driven by the hitching driving mechanism in the combined counterweight hitching device to move in the mounting hole to the hitching platform groove so as to complete a hitching operation.

9. The counterweight mounting structure of claim 8, wherein at least one locating groove is further provided on the turntable bottom framework bottom plate in the combined counterweight hitching device, and at least one locating block matched with the at least one locating groove is arranged on the upper counterweight.

10. A combined counterweight hitching method, comprising the following steps:

placing a combined counterweight on a vehicle frame, turning a turntable right astern and locking the turntable to locate the combined counterweight below a turntable tail framework;

driving a horizontal oil cylinder to extend and retract to drive a lifting oil cylinder fixing seat to move, so as to align the lifting oil cylinder with a mounting hole on the combined counterweight;

driving the lifting oil cylinder to extend out a piston rod to enable a hitching platform mounted at the piston rod end to enter the mounting hole in the combined counterweight;

driving the horizontal oil cylinder to extend and retract to drive the lifting oil cylinder fixing seat to move, so as to enable the hitching platform to enter a hitching platform groove on the combined counterweight; and driving the lifting oil cylinder to retract the piston rod to drive the combined counterweight to rise until the combined counterweight contacts a turntable tail framework bottom plate.

11. The combined counterweight hitching method of claim 10, wherein when placing the combined counterweight, the combined counterweight is placed and located under the assistance of a locating device arranged on the vehicle frame.

12. The combined counterweight hitching method of claim 10, wherein when driving the lifting oil cylinder to retract the piston rod to drive the combined counterweight to rise, a locating block on the combined counterweight cooperates with a locating groove on the turntable tail framework bottom plate for guiding.

* * * * *